US007934953B1

(12) United States Patent
Solis

(10) Patent No.: US 7,934,953 B1
(45) Date of Patent: May 3, 2011

(54) COAXIAL QUICK CONNECTOR ASSEMBLIES AND METHODS OF USE

(75) Inventor: Robert E. Solis, Litchfield Park, AZ (US)

(73) Assignee: Robert Solis, Litchfield Park, AZ (US)

( * ) Notice: Subject to any disclaimer, the term of this patent is extended or adjusted under 35 U.S.C. 154(b) by 0 days.

(21) Appl. No.: 12/717,941

(22) Filed: Mar. 4, 2010

(51) Int. Cl.
*H01R 9/05* (2006.01)

(52) U.S. Cl. ..... 439/578

(58) Field of Classification Search ..... 439/578–580, 439/700
See application file for complete search history.

(56) References Cited

U.S. PATENT DOCUMENTS 7,497,729 B1 * 3/2009 Wei ..... 439/578
* cited by examiner

*Primary Examiner* — Javaid Nasri

(57) ABSTRACT

In an embodiment, a coaxial quick connector assembly comprises an inner connector body having a first end for coupling with a coaxial cable and a second end having a perimeter contact for engagement with an externally threaded coaxial coupling. The perimeter contact includes a wall defining a central passageway. The perimeter wall includes at least one protrusion projecting toward the central passageway. An outer connector body is in mechanical communication with the inner connector body such that when the perimeter contact is engaged with the externally threaded coaxial coupling and the outer connector body is moved to an engaged position, an interior surface of the outer connector impinges the at least one protrusion between the interior surface of the outer connector body and the external surface of the externally threaded coaxial coupling, such that the assembly is held in place with respect to the threaded coaxial coupling.

20 Claims, 3 Drawing Sheets

COAXIAL QUICK CONNECTOR ASSEMBLIES AND METHODS OF USE

BACKGROUND

1. Technical Field

Aspects of the present document relate generally to connectors for use with coaxial cables and/or coaxial couplings, and more specifically to quick connectors for use with coaxial couplings.

2. Background Art

Various coaxial cables and cable connectors are known in the art. Coaxial cables, in conjunction with cable connectors, are typically used to connect in electronic communication one or more electronic devices and or lines such as one or more cable transmission lines, cable signal receivers, television components, video components, stereo components, computer components and/or the like. Coaxial cables are frequently flexible and typically include a center wire conductor surrounded by a tubular insulating layer which is further surrounded by a conductive layer, all of which may be encapsulated along the length of the cable with an exterior insulating layer 9.

One or more ends of a coaxial cable may be fitted with one or more cable connectors of various design. One common approach involves using "male" and "female" cable fittings to connect two or more particular components and/or transmission lines via a coaxial cable. By way of non-limiting example, a coaxial cable may commonly include on a first end a male-type fitting which may connect with a female type fitting (or vice-versa) associated with a cable transmission line provided by a cable service provider. By way of further non-limiting example, a coaxial cable may include on its second end another male-type coaxial fitting which may be coupled with an electronic device such as a television, cable receiver box, video player and/or recorder, stereo component, computer component and/or the like having one or more female type coaxial fittings (or vice-versa). Various adapters and couplers configured to adapt a male fitting to a female fitting and vice-versa are commercially available. In addition, various attempts have been made to provide cable connectors for use with commercially available coaxial cables, as well as for use with electronic devices capable of connecting with one or more other devices and/or transmission lines via a conventional coaxial cable.

SUMMARY

Aspects of this document relate to coaxial quick connector assemblies.

In one aspect, a coaxial quick connector assembly includes an inner connector body having a first end adapted to couple with a coaxial cable and a second end having a perimeter contact adapted to releasably engage with an external surface of an externally threaded coaxial coupling. The perimeter contact is in electrical communication with a conductive layer of the coaxial cable and includes at least one perimeter wall defining a central passageway at least partially surrounding a coaxial center wire, the at least one perimeter wall having at least one protrusion projecting toward the central passageway. An outer connector body in mechanical communication with the inner connector body and is positionable between an engaged position and a disengaged position. When the perimeter contact is engaged with the externally threaded coaxial coupling and the outer connector body is moved to the engaged position, an interior surface of the outer connector body limits movement of the at least one protrusion by impinging the at least one protrusion between the interior surface of the outer connector body and the external surface of the externally threaded coaxial coupling such that the assembly is held in place with respect to the threaded coaxial coupling.

Particular implementations may include one or more of the following. The first end may be threadably coupled and/or bonded with the coaxial cable. The at least one protrusion may project from the perimeter contact toward the central passageway only when the outer connector is moved towards the engaged position. At least a portion of the at least one protrusion may pass through at least one perimeter wall of the perimeter contact. At least one protrusion biasing element may bias the at least one protrusion towards the central passageway. At least one outer connector body biasing element may bias the outer connector body towards the engaged position.

In another aspect, a coaxial quick connector assembly comprises an inner connector body having a first end adapted to couple with a coaxial cable and a second end having a perimeter contact adapted to releasably engage with an external surface of an externally threaded coaxial coupling. The perimeter contact is in electrical communication with a conductive layer of the coaxial cable and includes at least one perimeter structure defining a central passageway at least partially surrounding a coaxial center wire. The perimeter contact is positionable between an engaged position and a disengaged position. A wedge element is in mechanical communication with at least a portion of the perimeter contact such that when the perimeter contact is moved to the disengaged position, an interior diameter of the perimeter contact is increased, and when the perimeter contact is moved to the engaged position an interior diameter of the perimeter contact is decreased.

Particular implementations may include one or more of the following. The first end may be threadably coupled and/or bonded with the coaxial cable. An outer connector body may be provided in mechanical communication with the perimeter contact, the outer connector body adapted to assist in moving the perimeter contact between the engaged position and the disengaged position. The perimeter contact may comprise a helical coil. The perimeter contact may comprise an expandable cuff. When the perimeter contact is in the engaged position with respect to the externally threaded coaxial coupling, at least a portion of the perimeter contact may be in mechanical communication with the external portion of the externally threaded coaxial coupling such that the assembly is held in place with respect to the threaded coaxial coupling. The perimeter contact may be biased towards the engaged position. The outer connector body may be biased towards the engaged position. At least one protrusion may project from the perimeter contact toward the central passageway, the at least one protrusion being adapted to engage the external surface of the threaded coaxial coupling when the perimeter contact is moved towards the engaged position.

In yet another aspect, a method of removably coupling a coaxial quick connector assembly with an externally threaded coaxial coupling comprises passing an externally threaded coaxial coupling into a central passageway of the perimeter contact and engaging an external surface of an externally threaded coaxial coupling with at least one protrusion of the perimeter contact. At least one protrusion is impinged between an interior surface of an outer connector body and the external surface of the externally threaded coaxial coupling such that the assembly is held in place with respect to the externally threaded coaxial coupling.

Particular implementations may include one or more of the following. Impinging the at least one protrusion between an interior surface of an outer connector body and the external surface of the externally threaded coaxial coupling may further comprise passing the at least one protrusion through a perimeter wall of the perimeter contact.

In still another aspect, a method of removably coupling a coaxial quick connector assembly with an externally threaded coaxial coupling comprises passing an externally threaded coaxial coupling into a central passageway of the perimeter contact and moving the perimeter contact to an engaged position such that an interior diameter of the perimeter contact is decreased. An external portion of the externally threaded coaxial coupling is engaged with at least a portion of the perimeter contact such that the assembly is held in place with respect to the threaded coaxial coupling.

Particular implementations may include one or more of the following. The perimeter contact may be moved to a disengaged position before passing an externally threaded coaxial coupling into the central passageway of the perimeter contact. The perimeter contact may also be biased to the engaged position.

The foregoing and other aspects, features, and advantages will be apparent to those having ordinary skill in the art from the DESCRIPTION and DRAWINGS, and from the CLAIMS.

BRIEF DESCRIPTION OF THE DRAWINGS

Various particular implementations of coaxial quick connector assemblies will hereinafter be described in conjunction with the appended drawings, where like designations denote like elements, and.

DESCRIPTION

This disclosure, its aspects and implementations, are not limited to the specific assemblies, components, features and/or methods of operation disclosed herein. Many additional assemblies, components, features and/or methods of operation consistent with the intended operation of a coaxial quick connector will become apparent from this disclosure. Accordingly, for example, although particular coaxial quick connector assemblies, inner connector bodies, first ends, coaxial cables, second ends, perimeter contacts, helical coils, wedge elements, interior diameters, external surfaces, externally threaded coaxial couplings, conductive layers, perimeter walls, perimeter structures, central passageways, protrusions, outer connector bodies, engaged positions, disengaged positions, interior surfaces, threaded couplings, bonded couplings, biasing elements, compression springs, and other components are disclosed, such particular coaxial quick connector assemblies, inner connector bodies, first ends, coaxial cables, second ends, perimeter contacts, helical coils, wedge elements, interior diameters, external surfaces, externally threaded coaxial couplings, conductive layers, perimeter walls, perimeter structures, central passageways, protrusions, outer connector bodies, engaged positions, disengaged positions, interior surfaces, threaded couplings, bonded couplings, biasing elements, compression springs, and implementing components may comprise any style, type, configuration, model, version and/or the like of any hardware and/or coupling that is known in the art for such coaxial quick connector assemblies, consistent with the intended operation of a coaxial quick connector assembly.

Figure 1:
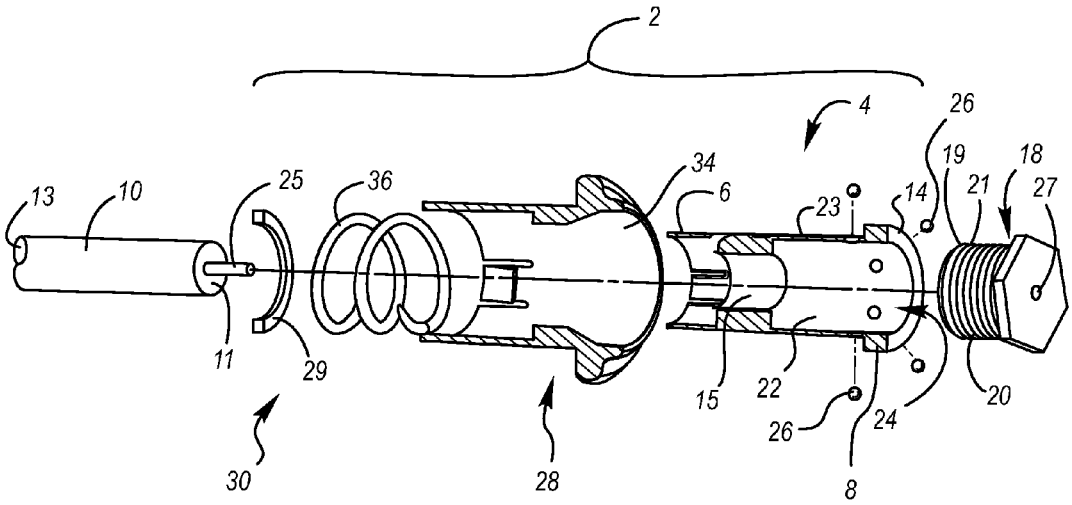
FIG. 1 illustrates a perspective view of a first particular implementation of a coaxial quick connector assembly in a disengaged position.
Figure 2:
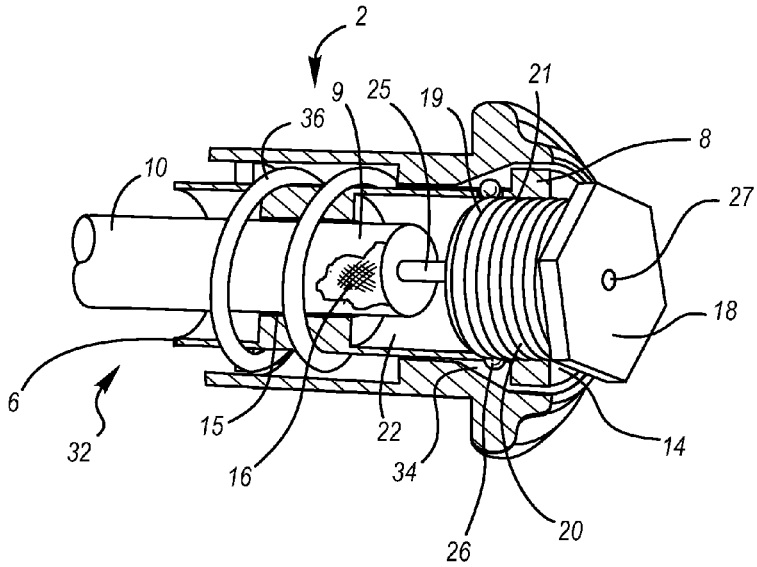
FIG. 2 illustrates a perspective cut-away view of the assembly shown by FIG. 1 engaged with respect to an externally threaded coaxial coupling.

There are a variety of particular implementations of coaxial quick connector assemblies disclosed herein. FIGS. 1 and 2 illustrate views of a first particular implementation of a coaxial quick connector assembly. A coaxial quick connector assembly 2 includes an inner connector body 4 which includes a first end 6 and a second end 8. It will be understood that a coaxial quick connector assembly 2, and other particular implementations of coaxial quick connector assemblies disclosed herein, may be used to connect a coaxial cable 10 to one or more externally threaded coaxial couplings 18 (such as, by way of non-limiting example, one or more conventional "F" type female coaxial connectors). It will be likewise understood that a first end 6 of an inner connector body 4 may be adapted to couple with a coaxial cable 10 in a variety of ways.

In some particular implementations, a first end 6 of an inner connector body 4 may be coupled with a coaxial cable 10 via the mechanical cooperation of two or more threaded fittings such as, by way of non-limiting example, the cooperation of a female coaxial fitting on the first end 6 with a male coaxial fitting attached to the coaxial cable 10 (and/or vice-versa). In such particular implementations, a coaxial quick connector assembly 2 may be provided for use as an "adapter" to convert an existing conventional hex type ("F" type) male coaxial connector on an existing coaxial cable 10 for use as a coaxial quick connector.

In other particular implementations, a first end 6 of an inner connector body 4 may be bonded (e.g. molded, formed, crimped, attached, and/or made integral with and/or integrated with) one or more coaxial cables 10 during a single manufacturing and/or assembly process and/or during multiple manufacturing and/or assembly processes. In such particular implementations, a coaxial quick connector assembly 2 may be provided pre-bonded and/or attached and/or integrated with one or more coaxial cables 10 and/or may be provided for use as a stand-alone coaxial fitting to be later bonded and/or attached by one or more users (such as at a worksite and/or at-home) to one or more sections of coaxial cable 10.

In any event, a second end 8 of an inner connector body 4 includes a perimeter contact 14 in electrical communication with a conductive layer 16 (FIG. 2) of a coaxial cable 10. In some particular implementations, a perimeter contact 14 may be in electrical communication with a conductive layer 16 via one or more traces 15 which may be disposed in one or more channels (not shown) in an outer wall 23 of the inner connector body 4.

A perimeter contact 14 includes at least one perimeter wall 22 defining a central passageway 24 through which a coaxial cable center conductor wire 25 may at least partially pass. It will be understood that the center wire 25 may be inserted in the center hole 27 of an externally threaded coaxial coupling 18 when coupling a coaxial quick connector assembly with an externally threaded coaxial coupling 18. As described further with respect to FIGS. 3-6, some particular implementations of coaxial quick connector assemblies disclosed herein may include one or more perimeter structures, rather than a perimeter wall.

In the particular implementation shown with respect to FIGS. 1 and 2, the at least one perimeter wall 22 comprises a single continuous wall defining a generally cylindrical central passageway 24. In other particular implementations, a perimeter wall 22 may be formed by one or more continuous or non-continuous structures (described further with respect to the particular implementation illustrated by FIGS. 5 and 6). In still other particular implementations, the at least one perimeter wall 22 may include two or more portions that cooperate to define a generally cylindrical central passageway 24.

While some of the particular implementations of coaxial quick connector assemblies illustrated herein are shown as having a perimeter contact having a generally round cylindrical shape when viewed from the end, it is specifically contemplated that, in some particular implementations, a perimeter contact may have a cylindrical shape other than generally round cylindrical shape when viewed from the end such as, by way of non-limiting example, triangular, trapezoidal, square, pentagonal, hexagonal, heptagonal, octagonal, nonagonal, decagonal, and/or the like.

Still referring to FIGS. 1 and 2, at least one perimeter wall 22 may include at least one protrusion 26 projecting from the perimeter wall 22 to the central passageway 24. It will be understood that one or more protrusions 26 are configured to engage and/or contact an external surface 20 (such as one or more ridges 19 and/or one or more lands 21). Depending upon the particular implementation, one or more protrusions 26 may comprise one or more spheres, pointed shapes, rounded shapes, edges, wires, clips, nibs and/or additional structures capable of protruding from a perimeter wall 22 and contacting an external surface 20 of an externally threaded coaxial coupling 18.

In some particular implementations, at least a portion of one or more protrusions 26 may pass through a perimeter wall 22 of a perimeter contact 14. In those particular implementations where at least a portion of one or more protrusions 26 pass through a perimeter wall 22, the one or more protrusions may be loosely fixed in position in a "floating" arrangement through a perimeter wall 22, whereby one or more protrusions are allowed some limited movement with respect to a perimeter wall 22 and/or a central passageway 24 (typically during disengagement), but are otherwise held in place with respect to the perimeter wall 22.

In other particular implementations, one or more protrusions 26 may project from a perimeter wall 22 toward a central passageway 24 only when a perimeter contact 14 is moved toward an engaged position (described further below with respect to FIG. 2). In still other particular implementations, one or more protrusions may be biased toward the central passageway 24 via one or more protrusion biasing elements (not shown).

Further describing the use of a coaxial quick connector assembly 2, a user desiring to attach a coaxial quick connector 2 to an externally threaded coaxial coupling 18 may pass an externally threaded coaxial coupling 18 into a central passageway 24 of a perimeter contact 14 (which is placed in electrical communication with a conductive layer of a coaxial cable) such that the center conductor wire 25 enters the center hole 27 of the externally threaded coaxial coupling 18. A user may then releasably engage or contact an external surface 20 of an externally threaded coaxial coupling 18 with at least one protrusion 26 of a perimeter contact 14.

As used herein "releasably engage" refers at least to a protrusion (such as a protrusion 26 and/or any other protrusions disclosed herein) and/or a portion of one or more perimeter contacts (such as perimeter contact 14, and/or any other perimeter contacts disclosed herein) being in contact with one or more external surfaces 20 of one or more externally threaded coaxial couplings 18 when a coaxial quick connector assembly of these disclosures and/or a component thereof is in an engaged position.

As further described herein, in some particular implementations, a protrusion (such as a protrusion 26 and/or any other particular implementation of protrusion disclosed herein) and/or a portion of one or more perimeter contacts (such as perimeter contact 14, and/or any other particular implementation of perimeter contact disclosed herein) may be further lockably engaged with an externally threaded coaxial coupling 18 such that considerable pressure and/or force may be required to remove the perimeter contact (and/or the protrusion) from an externally threaded coaxial coupling 18 without first disengaging one or more perimeter contacts, protrusions, outer coupling bodies, and/or any other component defining any particular implementation of coaxial quick connector assembly disclosed herein.

"Releasably engage" may then further encompass at least allowing one or more perimeter contacts (and/or one or more protrusions) to ease and/or cease contact and/or engagement with one or more external surfaces 20 of one or more externally threaded coaxial couplings 18 when a coaxial quick connector assembly and/or a component thereof is moved toward an disengaged position. Accordingly, a protrusion and/or a portion of one or more perimeter contacts may be released and/or eased from contact with an externally threaded coupling 18 via disengagement of the protrusion 26 and/or another portion of one or more perimeter contacts 14 (and/or via another component such as a outer connector body 28), such that considerable pressure and/or force may not be required to remove the perimeter contact 14 (and/or the assembly) from an externally threaded coaxial coupling 18.

In the particular implementation illustrated with respect to FIGS. 1 and 2, a user may move an outer connector body 28 to an engaged position in order to lockably engage an external surface 20 of an externally threaded coaxial coupling 18 with at least one protrusion 26. Specifically, an outer connector body 28 is in mechanical cooperation with the inner connector body 4 and is positionable between a disengaged position 30 (illustrated by FIG. 1), and an engaged position 32 (shown in FIG. 2). In some particular implementations, an outer connector body 28 may be biased towards an engaged position 32 via one or more connector body biasing elements 36 (which may be held in place with and/or compressed against one or more retainer elements 29). Accordingly, in such particular implementations, a mechanical force (such as from a user's hand or tool) may be required to move the outer connector body 28 towards the disengaged position 30.

In any event, when an outer connector body 28 is in its disengaged position 30, one or more protrusions 26 may be allowed some movement with respect to an inner connector body 4 and/or a perimeter wall 22 and/or an external surface 20 of an externally threaded coaxial coupling 18, depending upon the particular implementation.

Notwithstanding, when an outer connector body 28 is moved towards its engaged position 32 (FIG. 2), an interior surface 34 of the outer connector body 28 may come into contact with one or more protrusions 26. As the interior surface 34 of the outer connector body 28 contacts one or more protrusions 26 (FIG. 2), the one or more protrusions 26 may become limited in their movement. When the outer connector body 28 is moved to a fully engaged position 32, the one or more protrusions 26 may become impinged (e.g. trapped and/or wedged) between the interior surface 34 of the outer connector body 28 and an external surface 20 of an externally threaded coaxial coupling 18 such that the assembly 2 is held in place respect to the externally threaded coaxial coupling 18. As used herein, "held in place" refers at least to a coaxial quick connector assembly and/or component thereof (such as a perimeter contact and/or a protrusion) being fixedly attached with respect to an externally threaded coaxial coupling 18 and/or where one or more components defining a coaxial quick connector assembly are pivotably, rotatably, flexibly, and/or otherwise positionably attached with respect to an externally threaded coaxial coupling 18.

"Held in place" may further include, as used herein, those instances where a particular implementation of a coaxial quick connector assembly disclosed herein is held in place sufficiently securely with respect an externally threaded coaxial coupling 18 that the coaxial quick connector assembly (including one or more perimeter contacts, protrusions, and/or other components) can support itself along with a coaxial cable 10 and/or associated connectors, hardware, etc. therefrom when the coaxial quick connector assembly is coupled with the externally threaded coaxial coupling 18. As noted above, an outer connector body 28 may be biased towards an engaged position such that, once engaged, the outer connector body will favor remaining in the engaged position 32.

While the particular implementation shown with respect to FIGS. 1 and 2 illustrates an outer coaxial body 28 being slidably positioned between a disengaged position 30 and an engaged position 32, it will be understood that additional positionability and/or movement of one or more outer coaxial bodies 28 between a disengaged position 30 and an engaged position 32 may be accomplished in additional ways.

Describing the use of the coaxial quick connector assembly 2 further, with a first end 6 of an inner connector body 4 coupled with a coaxial cable 10 such that a perimeter contact 14 is in contact with a conductive layer 16 of the coaxial cable, a user may then releasably couple a second end 8 of the inner connector body to one or more externally threaded coaxial couplings 18 according to the disclosures set forth above. It will be understood that a distal end 13 of the coaxial cable 10 may be coupled in electronic communication with any electronic device, transmission line, component, receiver, system and/or interface capable of communicating , transmitting, receiving, processing and/or displaying one or more communications signals. Such devices and components may include any cable transmission line, television, video and/or recorder, stereo component, personal computing component, cable receiver box, home control apparatus, home security component and/or any other device configured to communicate and/or receive one or more signals via one or more coaxial cables.

It will be further understood that one or more communication signals may be provided along a coaxial cable 10, from a distal end 13 to a proximal end 11 to one or more externally threaded coaxial couplings 18 which may be in communication with and/or integrated with one or more electronic devices, components, systems and/or interfaces. Accordingly, from these disclosures it will be appreciated that a coaxial quick connector assembly may be particularly useful in allowing users to efficiently allow one or more signals to be communicated between one or more devices, transmission lines, components, receivers, systems and/or interfaces via a one or more coaxial cables 10, via one or more coaxial quick connector assemblies disclosed herein.

Figure 3:
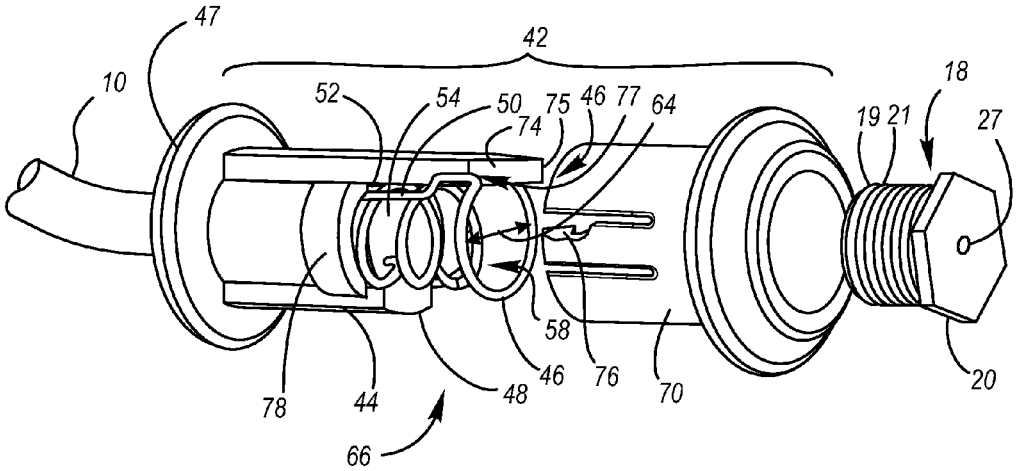
FIG. 3 illustrates a perspective view of a second particular implementation of a coaxial quick connector assembly in a disengaged position.
Figure 4:
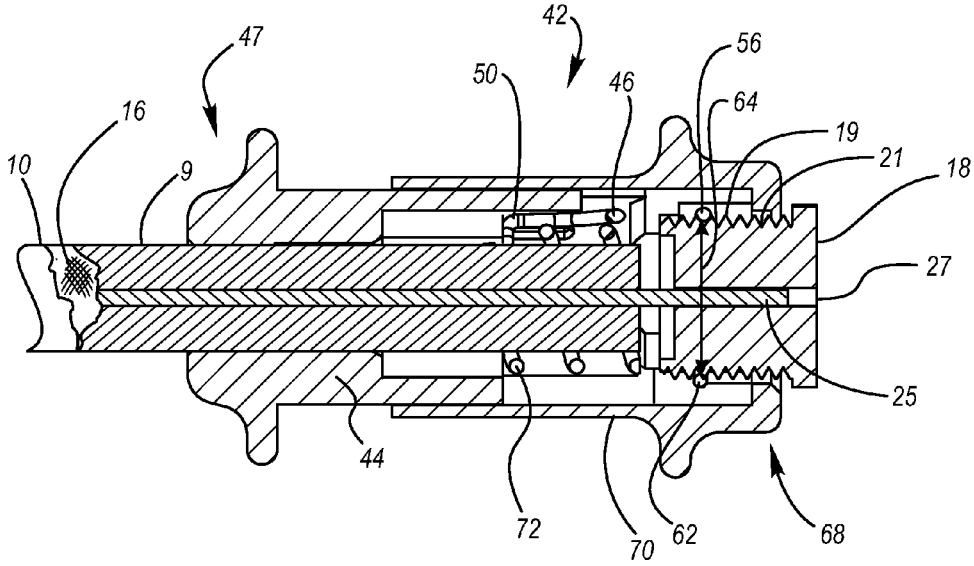
FIG. 4 illustrates a perspective cut-away view of the assembly shown by FIG. 3 engaged with respect to an externally threaded coaxial coupling.

Turning now to FIGS. 3 and 4, a second particular implementation of a coaxial quick connector assembly 42 is illustrated. A coaxial quick connector assembly 42 includes an inner connector body 44 having a first end 47 and a second end 48. As with the first particular implementation described with respect to FIGS. 1 and 2, a first end 47 of an inner connector body 44 may be adapted to couple with a coaxial cable 10 in a variety of ways, such as threaded cooperation, molding, bonding, crimping, and/or other ways of attachment.

A second end 48 of an inner connector body 44 includes a perimeter contact 46 in electrical communication with a conductive layer 16 of one or more coaxial cables 10. In some particular implementations, a perimeter contact 46 may be in electrical communication with a conductive layer 16 via one or more traces or arms 50 which may run into one or more channels 52 in an inner wall 54 of the inner connector body 44. Significantly, a perimeter contact 46 includes at least one perimeter structure 56 defining a central passageway 58 through which a coaxial cable center wire 25 may pass. A comparison of the particular implementation of coaxial quick connector assembly 42 illustrated by FIGS. 3 and 4 to that illustrated by FIGS. 1 and 2 (assembly 2), it will be appreciated that the particular implementation of coaxial quick connector assembly 42 illustrated by FIGS. 3 and 4, may include one or more perimeter structures 56, rather than a perimeter wall 22.

In the particular implementation shown, at least one perimeter structure 56 (and/or one or more perimeter contacts 46) may be formed by one or more curved and/or bent elements such as one or more helical springs. At least one perimeter structure 56 (and/or one or more perimeter contacts 46 and/or one or more helical springs) may include two or more portions that cooperate to define a generally cylindrical central passageway 58. In other particular implementations, a perimeter structure 56 (and/or one or more perimeter contacts 46) may be formed by one or more continuous and/or nearly-continuous structures.

Still referring to FIGS. 3 and 4, this particular implementation of coaxial quick connector assembly includes a protrusion 62 projecting from a perimeter structure 56 toward the central passageway 58. It will be understood that one or more protrusions 62 may be configured to engage and/or contact one or more ridges 19 and/or one or more lands 21 of an externally threaded coaxial coupling 18. Depending upon the particular implementation, one or more protrusions 62 may comprise one or more spheres, pointed shapes, rounded shapes, edges, wires, clips, nibs and/or additional structures capable of protruding from a perimeter structure and contacting an external surface 20 of an externally threaded coaxial coupling 18.

In the particular implementation shown with respect to FIGS. 3 and 4, one or more perimeter contacts 46 and/or protrusions 62 may be biased toward the central passageway 58 at least via the particular configuration of the one or more helical springs, which may be configured to have a bias (and/or exert compression force) towards the central passageway 58 when in a standing (engaged) state.

Describing the use of a coaxial quick connector 42 further, a user desiring to attach a coaxial quick connector 42 to an externally threaded coaxial coupling 18 may move a perimeter contact 46 to a disengaged position 66 (shown in FIG. 3), such that an interior diameter 64 of the perimeter contact 46 is increased.

A user may also pass an externally threaded coaxial coupling 18 into a central passageway 58 of a perimeter contact 46 and then releasably engage an external surface 20 of an externally threaded coaxial coupling 18 with at least a portion of a perimeter contact 46 by moving the perimeter contact 46 to the engaged position 68 (FIG. 4). As described further below, when moved to the engaged position, an interior diameter 64 of the perimeter contact 46 is decreased (as shown by 64*b* in FIG. 4).

Significantly, when a perimeter contact 46 is moved toward its disengaged position 66 (whether or not assisted by an outer connector body 70), a wedge element 74 may come into mechanical communication with at least a portion of the perimeter contact 46 such that an interior diameter 64 of the perimeter contact 46 is increased. In the particular implementation shown by FIGS. 3 and 4, a wedge element 74 comprises a generally picket shaped element, as shown by FIGS. 3 and 4. A point 75 of the wedge 74 contacts a joint 77 in the perimeter contact 46 as the perimeter contact 46 is moved toward a disengaged position 66. As the wedge impacts the joint 77, the joint is spread apart, causing an interior diameter 64 of the perimeter contact 46 to be increased, thereby allowing a user to easily slide the perimeter contact 46 onto one or more externally threaded coaxial couplings 18. Notwithstanding, in other particular implementations, a wedge 74 may be shaped and/or configured differently such as, by way of non-limiting example, one or more continuous or non-continuous ramps located around a perimeter of an inner connector body (shown and described with respect to FIGS. 5 and 6), and/or other configurations.

It will be understood that when a user moves a perimeter contact 46 to its engaged position 68, an interior diameter 64 of the perimeter contact 46 is decreased at least due to the wedge 74 becoming un-wedged from the joint 77. It will be further understood that when a perimeter contact 46 is in the engaged position 68, at least a portion of the perimeter contact 46 (and/or one or more protrusions 62) may be in mechanical communication (such as via a compression fit and/or via the engagement of one or more perimeter contact 46 portions and/or protrusions 62) with the externally threaded coaxial coupling 18 such that the coaxial quick connector assembly 42 is held in place with respect to the threaded coaxial coupling 18.

In some particular implementations, such as that shown with respect to FIGS. 3 and 4, an outer connector body 70 may be provided in mechanical communication with a perimeter contact 46 to assist in moving the perimeter contact 46 between the engaged position 68 and the disengaged position 66. In some particular implementations, an outer connector body 70 may be biased towards the engaged position 68 via one or more compression springs 72. Accordingly, in such particular implementations, a mechanical force (such as from a user's hand or tool) may be required to move the outer connector body 70 towards the disengaged position 66. With respect to any of the particular implementations disclosed herein, the mechanical cooperation of one or more barbs 76 (which may be integrated with one or more outer connector bodies) with one or more shoulders 78 (which may be integrated with one or more inner connector bodies) may allow an outer connector body and an inner connector body to be snap-fit together for their sliding cooperation, and may further assist in resisting their de-coupling once fit together.

While the particular implementations shown with respect to FIGS. 3 and 4 (and FIGS. 5 and 6, below) illustrate an outer connector body being slidably positioned between a disengaged position and an engaged position, it will be understood that additional positionability and/or movement of one or more outer coaxial bodies (and/or perimeter contacts) between a disengaged position and an engaged position may be accomplished in additional ways.

Further describing the use of the coaxial quick connector assembly 42, with a first end 47 of an inner connector body 44 coupled with a coaxial cable 10 (specifically, a proximal end 11) such that a perimeter contact 46 is in contact with a conductive layer 16 of the coaxial cable, a user may then removably attach a second end 48 of the inner connector body to one or more externally threaded coaxial couplings 18 according to the disclosures set forth above.

Figure 5:
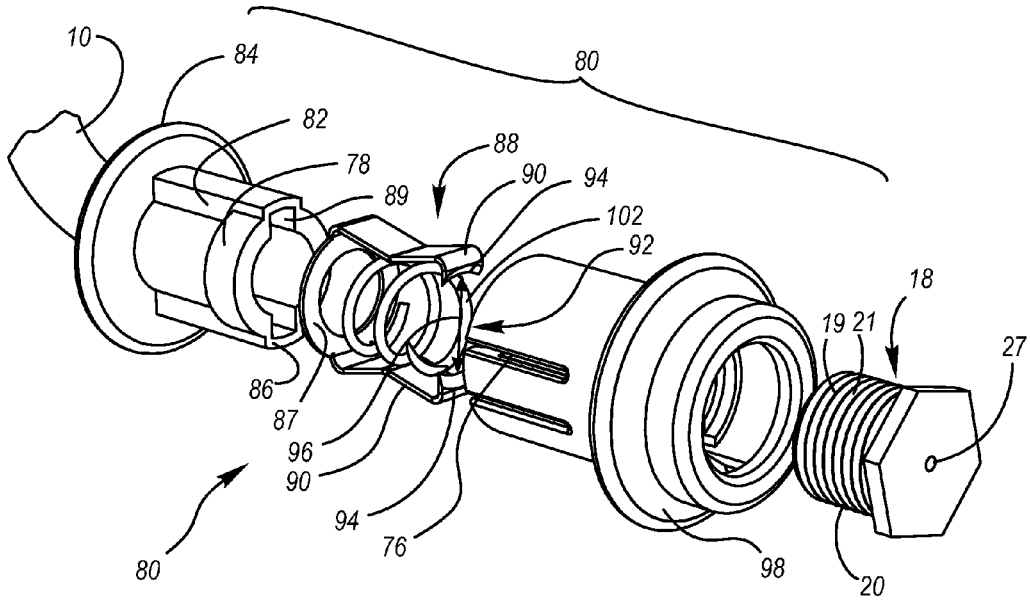
FIG. 5 illustrates a perspective view of a third particular implementation of a coaxial quick connector assembly in a disengaged position.
Figure 6:
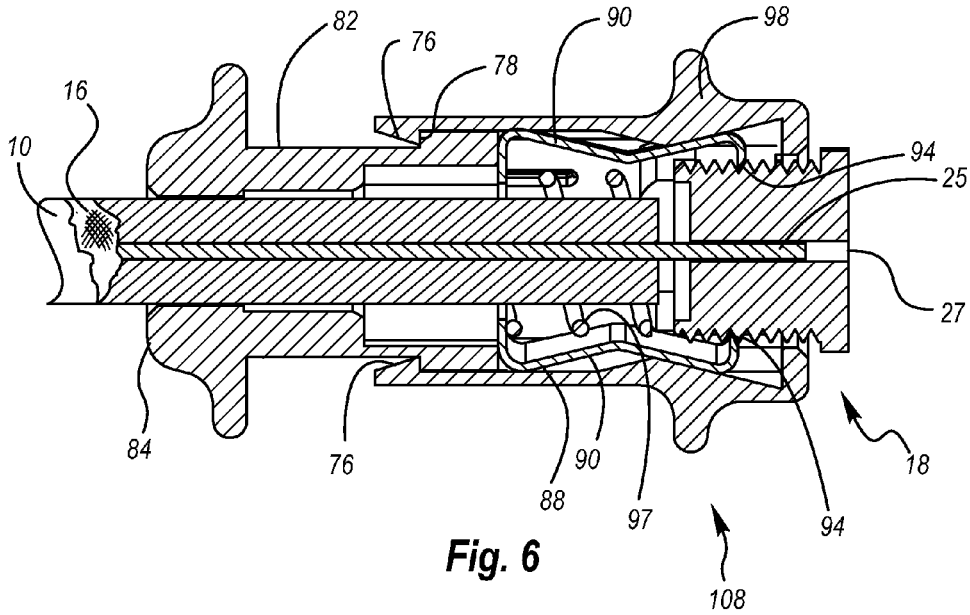
FIG. 6 illustrates a perspective cut-away view of the assembly shown by FIG. 5 engaged with respect to an externally threaded coaxial coupling.

Turning now to FIGS. 5 and 6, an additional particular implementation of a coaxial quick connector assembly is illustrated and disclosed. A coaxial quick connector assembly 80 comprises an inner connector body 82 which includes a first end 84 and a second end 86. As with the other particular implementations of coaxial quick connector assemblies disclosed herein, a first end 84 of an inner connector body 82 may be adapted to couple with a coaxial cable 10 in a variety of ways, such as threaded cooperation, molding, bonding, crimping, and other ways of attachment.

A second end 86 of an inner connector body 82 includes a perimeter contact 88 in electrical communication with a conductive layer 16 of one or more coaxial cables 10. In some particular implementations, a perimeter contact 88 may be in electrical communication with a conductive layer 16 via one or more traces or arms 87 which may run into one or more channels 89 in an inner wall of the inner connector body 82. Significantly, a perimeter contact 88 may include at least one perimeter structure 90 defining a central passageway 92 through which a coaxial cable center wire 25 may pass. A comparison of the particular implementation of coaxial quick connector assembly 80 illustrated by FIGS. 5 and 6 to that illustrated by FIGS. 3 and 4 (assembly 42), it will be appreciated that the particular implementation of perimeter structure 90 illustrated by FIGS. 5 and 6, may include one or more edges 94 (which may be beveled, in some particular implementations.

The coaxial quick connector assembly 80 shown with respect to FIGS. 5 and 6 includes at least one perimeter structure 90 that may be formed by one or more opposing and/or continuous structures, such as one or more flexible "tongs" having one or more edges 94. The one or more perimeter contacts 88 (and/or one or more perimeter structures 90) may further define an interior diameter 96 that may be increased and/or increasable as an outer connector body 98 is moved to a disengaged position 100. Specifically, in the particular implementation shown, when an outer connector body 98 is in its disengaged position 100, one or more perimeter structures 90 may be allowed some flex and/or movement with respect to an external surface 20 of an externally threaded coaxial coupling 18. In some particular implementations, one or more perimeter structures 90 may be biased towards the engaged position 108 (FIG. 6). In any event, one or more perimeter structures 90 may be prevented from flexing or moving via the impingement of at least a portion of the outer connector body 98 on the one or more perimeter structures when the outer connector body is in its engaged position 108 (FIG. 6).

In some particular implementations, one or more shoulders 78 may be included with one or more inner coupling bodies 82, in order to allow an outer connector body 98 to be snap-fit together with an inner connector body 82 (and resist decoupling) via the mechanical cooperation of one or more barbs 76 with one or more shoulders 78.

In some particular implementations, an outer coupling body may be biased towards an engaged position via one or more compression springs 102.

A user desiring to attach a coaxial quick connector 80 to an externally threaded coaxial coupling 18 may move the outer coupling body 98 to a disengaged position 100 (FIG. 5) such that an interior diameter 96 of the perimeter contact 88 is increasable and so that a user may be allowed to easily slip a perimeter contact 88 on and off one or more externally threaded coaxial couplings 18, due at least to the increasable diameter of the central passageway 92. A user may also pass an externally threaded coaxial coupling 18 into a central passageway 92 of a perimeter contact 88 (which is placed in electrical communication with a conductive layer of a coaxial cable). A user may then releasably engage an external surface 20 of an externally threaded coaxial coupling 18 with at least a portion of a perimeter contact 88 by moving the outer coupling body 98 to its engaged position 108 (FIG. 6) such that an interior diameter 92 of the perimeter contact 88 is decreased and one or more edges 94 grip one or more threads of the threaded coupling 18. As an interior diameter 92 of the perimeter contact 88 is decreased, at least a portion of the perimeter contact 88 (and/or one or more protrusions 118) may be into mechanical communication with the externally threaded coaxial coupling 18, such that the coaxial quick connector assembly 80 is held in place with respect to the threaded coaxial coupling 18. Mechanical cooperation may include a compression fit and/or the engagement of one or more perimeter contact 88 portions and/or edges 94 with respect to the externally threaded coaxial coupling 18.

In those particular implementations of coaxial quick connector assembly 80 having an outer connector body 98, the outer connector body 98 may be in mechanical communication with one or more perimeter contacts 88 at least to assist in moving the perimeter contact 88 between an engaged position 100 and a disengaged position 108. In some particular implementations, an outer connector body 98 may be biased to an engaged position such as with a compression spring 97. Accordingly, as with other particular implementations disclosed herein, a mechanical force (such as from a user's hand or tool) may be required to move the outer connector body 98 towards the disengaged position 100.

With a first end 84 of an inner connector body 82 coupled with a coaxial cable 10 such that a perimeter contact 88 is in contact with a conductive layer 16 of the coaxial cable, a user may then removably attach a second end 86 of the inner connector body to one or more externally threaded coaxial couplings 18 according to the disclosures set forth above.

The assemblies, components, devices, and methods of the present teachings may provide many low-cost, efficient ways for users to attach two or more electrical devices and/or transmission lines via a coaxial cable. The present teachings therefore provide an economical way of allowing users to quickly couple two or more electrical devices in communication via one or more coaxial cables. It will be understood that, in a relatively short period of time, the costs of systematic implementation of the present teachings may be offset by efficiencies in manufacturing, installation, and labor.

Those skilled in the art can appreciate from the foregoing description that the present teachings can be implemented in a variety of forms. Therefore, while these teachings have been described in connection with particular embodiments and examples thereof, the entire scope of the present teachings should not be so limited. Various changes and modifications may be made, including combining aspects and features among various particular implementations disclosed herein, without departing from the scope of the teachings herein.

The invention claimed is:

1. A coaxial quick connector assembly comprising:

an inner connector body having a first end adapted to couple with a coaxial cable and a second end having a perimeter contact adapted to releasably engage with an external surface of an externally threaded coaxial coupling;

the perimeter contact in electrical communication with a conductive layer of the coaxial cable and including at least one perimeter wall defining a central passageway at least partially surrounding a coaxial center wire, the at least one perimeter wall having at least one protrusion projecting toward the central passageway;

an outer connector body in mechanical communication with the inner connector body and positionable between an engaged position and a disengaged position;

wherein when the perimeter contact is engaged with the externally threaded coaxial coupling and the outer connector body is moved to the engaged position, an interior surface of the outer connector body limits movement of the at least one protrusion by impinging the at least one protrusion between the interior surface of the outer connector body and the external surface of the externally threaded coaxial coupling such that the assembly is held in place with respect to the threaded coaxial coupling.

2. The assembly of claim 1, wherein the first end is one of threadably coupled and bonded with the coaxial cable.

3. The assembly of claim 1, wherein the at least one protrusion projects from the perimeter contact toward the central passageway only when the outer connector is moved towards the engaged position.

4. The assembly of claim 1, wherein at least a portion of the at least one protrusion passes through the at least one perimeter wall of the perimeter contact.

5. The assembly of claim 1, wherein at least one protrusion biasing element biases the at least one protrusion towards the central passageway.

6. The assembly of claim 1, wherein at least one outer connector body biasing element biases the outer connector body towards the engaged position.

7. A coaxial quick connector assembly comprising:

an inner connector body having a first end adapted to couple with a coaxial cable and a second end having a perimeter contact adapted to releasably engage with an external surface of an externally threaded coaxial coupling;

the perimeter contact in electrical communication with a conductive layer of the coaxial cable and having at least one perimeter structure defining a central passageway at least partially surrounding a coaxial center wire, the perimeter contact positionable between an engaged position and a disengaged position;

a wedge element in mechanical communication with at least a portion of the perimeter contact such that when the perimeter contact is moved to the disengaged position an interior diameter of the perimeter contact is increasable, and when the perimeter contact is moved to the engaged position an interior diameter of the perimeter contact is decreasable.

8. The assembly of claim 7, wherein the first end is one of threadably coupled and bonded with the coaxial cable.

9. The assembly of claim 7, further comprising an outer connector body in mechanical communication with the perimeter contact, the outer connector body adapted to assist in moving the perimeter contact between the engaged position and the disengaged position.

10. The assembly of claim 7, wherein the perimeter contact comprises a helical coil.

11. The assembly of claim 7, wherein the perimeter contact comprises an expandable cuff.

12. The assembly of claim 7, wherein when the perimeter contact is in the engaged position with respect to the externally threaded coaxial coupling, at least a portion of the perimeter contact is in mechanical communication with the external portion of the externally threaded coaxial coupling such that the assembly is held in place with respect to the threaded coaxial coupling.

13. The assembly of claim 7, wherein the perimeter contact is biased towards the engaged position.

14. The assembly of claim 7, wherein the outer connector body is biased towards the engaged position.

15. The assembly of claim 7, further comprising at least one protrusion projecting from the perimeter contact toward the central passageway, the at least one protrusion adapted to engage the external surface of the threaded coaxial coupling when the perimeter contact is moved towards the engaged position.

16. A method of removably coupling a coaxial quick connector assembly with an externally threaded coaxial coupling comprising:

passing an externally threaded coaxial coupling into a central passageway of the perimeter contact;

engaging an external surface of an externally threaded coaxial coupling with at least one protrusion of the perimeter contact; and impinging the at least one protrusion between an interior surface of an outer connector body and the external surface of the externally threaded coaxial coupling such that the assembly is held in place with respect to the externally threaded coaxial coupling.

17. The method of claim 16, wherein impinging the at least one protrusion between an interior surface of an outer connector body and the external surface of the externally threaded coaxial coupling further comprises passing the at least one protrusion through a perimeter wall of the perimeter contact.

18. A method of removably coupling a coaxial quick connector assembly with an externally threaded coaxial coupling comprising:

passing an externally threaded coaxial coupling into a central passageway of the perimeter contact;

moving the perimeter contact to an engaged position such that an interior diameter of the perimeter contact is decreased; and engaging an external portion of the externally threaded coaxial coupling with at least a portion of the perimeter contact such that the assembly is held in place with respect to the threaded coaxial coupling.

19. The method of claim 18, further comprising moving the perimeter contact to a disengaged position before passing an externally threaded coaxial coupling into the central passageway of the perimeter contact.

20. The method of claim 18, wherein moving the perimeter contact to an engaged position comprises biasing the perimeter contact to the engaged position.

* * * * *